US009944483B2

(12) United States Patent
Inoue et al.

(10) Patent No.: US 9,944,483 B2
(45) Date of Patent: Apr. 17, 2018

(54) PRINTER

(71) Applicant: RISO KAGAKU CORPORATION, Tokyo (JP)

(72) Inventors: Hideaki Inoue, Ibaraki (JP); Masashi Hara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 105 days.

(21) Appl. No.: 14/968,015

(22) Filed: Dec. 14, 2015

(65) Prior Publication Data

US 2016/0185542 A1 Jun. 30, 2016

(30) Foreign Application Priority Data

Dec. 26, 2014 (JP) ..... 2014-265080

(51) Int. Cl.
*B65H 9/00* (2006.01)
*B65H 7/02* (2006.01)

(52) U.S. Cl.
CPC ..... *B65H 9/006* (2013.01); *B65H 7/02* (2013.01); *B65H 2511/514* (2013.01); *B65H 2513/10* (2013.01); *B65H 2513/50* (2013.01); *B65H 2513/53* (2013.01); *B65H 2701/1311* (2013.01); *B65H 2701/1313* (2013.01)

(58) Field of Classification Search
CPC ..... B65H 9/004; B65H 9/006; B65H 7/02; B65H 2513/10; B65H 2513/50
See application file for complete search history.

(56) References Cited

U.S. PATENT DOCUMENTS 5,197,726 A 3/1993 Nogami
5,323,814 A 6/1994 Shiraki et al.
8,439,345 B2 * 5/2013 Inoue ..... B65H 5/34 271/10.01
2009/0039588 A1 2/2009 Suzuki et al.
2010/0002037 A1 1/2010 Kusuhata
(Continued)

FOREIGN PATENT DOCUMENTS

CN 1076974 10/1993
CN 102476512 5/2012
(Continued)

OTHER PUBLICATIONS

Search Report issued by European Patent Office (EPO) patent office in European Patent Office (EPO) Patent Application No. 15201577.2, dated Jun. 3, 2016.
(Continued)

*Primary Examiner* — Michael C McCullough
(74) *Attorney, Agent, or Firm* — Greenblum & Bernstein, P.L.C.

(57) ABSTRACT

A controller is configured to drive a conveying roller to allow a sheet to abut on a registration roller and stop, and to drive the registration roller to convey the sheet abutting on the registration roller to the printing unit at a set sheet interval. The controller is configured to control a conveying speed of the conveying roller based on a time from a first timing to a second timing, the first timing at which a preceding sheet conveyed from the registration roller to the printing unit exits the conveying roller, the second timing at which a following sheet reaches the conveying roller.

3 Claims, 5 Drawing Sheets

(56) References Cited

U.S. PATENT DOCUMENTS

| | | | | |
|---|---|---|---|---|
| 2010/0237557 | A1 | 9/2010 | Hara et al. | |
| 2012/0134731 | A1 | 5/2012 | Fukusada et al. | |
| 2013/0015620 | A1* | 1/2013 | Inoue ..... | B65H 5/34<br>271/10.11 |

FOREIGN PATENT DOCUMENTS

| | | |
|---|---|---|
| JP | 2000-3079 | 1/2000 |
| JP | 2007-76343 | 3/2007 |
| JP | 2010-30296 | 2/2010 |

OTHER PUBLICATIONS

Office Action issued in China Counterpart Patent Appl. No. 201510965124.8, dated Aug. 3, 2017.

* cited by examiner

PRINTER

CROSS REFERENCE TO RELATED APPLICATION

This application is based upon and claims the benefit of priority from the prior Japanese Patent Application No. 2014-265080, filed on Dec. 26, 2014, the entire contents of which are incorporated herein by reference.

BACKGROUND

1. Technical Field

The disclosure relates to a printer configured to perform printing on sheets.

2. Related Art

Japanese Patent Application Publication No. 2010-30296 describes a printer including a mechanism which corrects skewing of each of sheets by causing the sheet to abut on registration rollers and then conveys the sheet to a printing unit including inkjet heads and the like.

The registration rollers are driven at timing corresponding to a printing schedule of the printing unit. Conveying rollers (upstream conveying rollers) configured to send the sheets picked up from a paper feed tray to the registration rollers send out each sheet to the registration roller in synchronization with the drive timing of the registration rollers.

Moreover, among printers capable of performing duplex printing, there is a printer in which the upstream conveying rollers configured to send the sheets picked up from paper feed tray to the registration rollers also have a function of sending the sheets printed on front sides to the registration rollers. In such a printer, the upstream conveying rollers send out both the sheets picked up and conveyed from the paper feed tray and the sheets printed on the front sides and then conveyed and circulated, to the registration rollers in synchronization with the drive timings of the registration rollers.

SUMMARY

Delay of sheets sometimes occurs in a conveying route to the upstream conveying rollers described above. Then, due to this sheet delay, a timing at which each sheet reaches the registration rollers is sometimes delayed from a theoretical value of the reaching timing. As a result, the sheets may be jammed by overlapping or colliding with each other.

In view of this, a technique is put to use in which the sheet delay is detected by using a sheet sensor provided in the conveying route to the upstream conveying rollers and is corrected by controlling the conveying speed in the conveying route to the upstream conveying rollers, based on the detection result. In the configuration in which the upstream conveying rollers configured to send the sheets conveyed from the paper feed tray to the registration rollers also have the function of sending the sheets, printed on the front side and then conveyed and circulated, to the registration rollers, the sheet delay is corrected by controlling the conveying speeds in the respective conveying routes.

Correcting the delay of the sheets sent to the upstream rollers as described above can correct a timing at which each sheet reaches the registration rollers. However, there is a demand for a technique capable of correcting the timing at which each sheet reaches the registration rollers more easily.

An object of the disclosure is to provide a printer which can easily correct a timing at which a sheet reaches registration rollers.

A printer in accordance with some embodiments includes: a conveyer configured to convey sheets at a plurality of conveying speeds; a conveying roller configured to receive a sheet conveyed by the conveyer at a receiving speed corresponding to a conveying speed in the conveyer and convey the sheet; a registration roller configured to convey the sheet conveyed by the conveying roller to a printing unit; and a controller configured to drive the conveying roller to allow the sheet to abut on the registration roller and stop, and to drive the registration roller to convey the sheet abutting on the registration roller to the printing unit at a set sheet interval. The controller is configured to control a conveying speed of the conveying roller based on a time from a first timing to a second timing, the first timing at which a preceding sheet conveyed from the registration roller to the printing unit exits the conveying roller, the second timing at which a following sheet reaches the conveying roller.

In the configuration described above, also in the case where the sheets are conveyed to the conveying rollers at the plurality of types of speeds, a timing at which each sheet reaches the registration roller can be easily corrected by using the time from the timing at which the preceding sheet exits the conveying roller to the timing at which the following sheet reaches the conveying roller.

The conveying roller may be configured to convey the sheet at the receiving speed and then convey the sheet so as to allow the sheet to abut on the registration roller at an abutting speed slower than the receiving speed and stop. The controller may be configured to control a conveying time of the conveying roller at the receiving speed and a conveying time of the conveying roller at the abutting speed, based on the time from the first timing to the second timing.

In the configuration described above, the timing at which each sheet reaches the registration roller can be easily corrected in the conveying speed control in which colliding noise of the sheet is suppressed by causing the sheet to abut on the registration roller at the abutting speed slower than the receiving speed.

The conveyer may include: a paper feeding conveyer configured to convey the sheet picked up from a paper feed tray; and a paper refeeding conveyer configured in duplex printing to convey the sheet with a front side printed at a conveying speed different from a conveying speed of the paper feeding conveyer.

In the configuration described above, the timing at which each sheet reaches the registration roller can be easily corrected also in duplex printing in which the sheets are conveyed from the paper feeding conveyer and the paper refeeding conveyer to the conveying roller at different conveying speeds.

The conveyer may be configured to conveys each of the sheets picked up from a plurality of paper feed trays at a conveying speed set for the paper feed tray from which the sheet is fed, among different conveying speeds set for the respective paper feed trays.

In the configuration described above, the timing at which each sheet reaches the registration roller can be easily corrected also in the case where the sheets picked up from the plurality of paper feed trays are conveyed to the conveying roller at the different conveying speeds.

DETAILED DESCRIPTION

Figure 1:
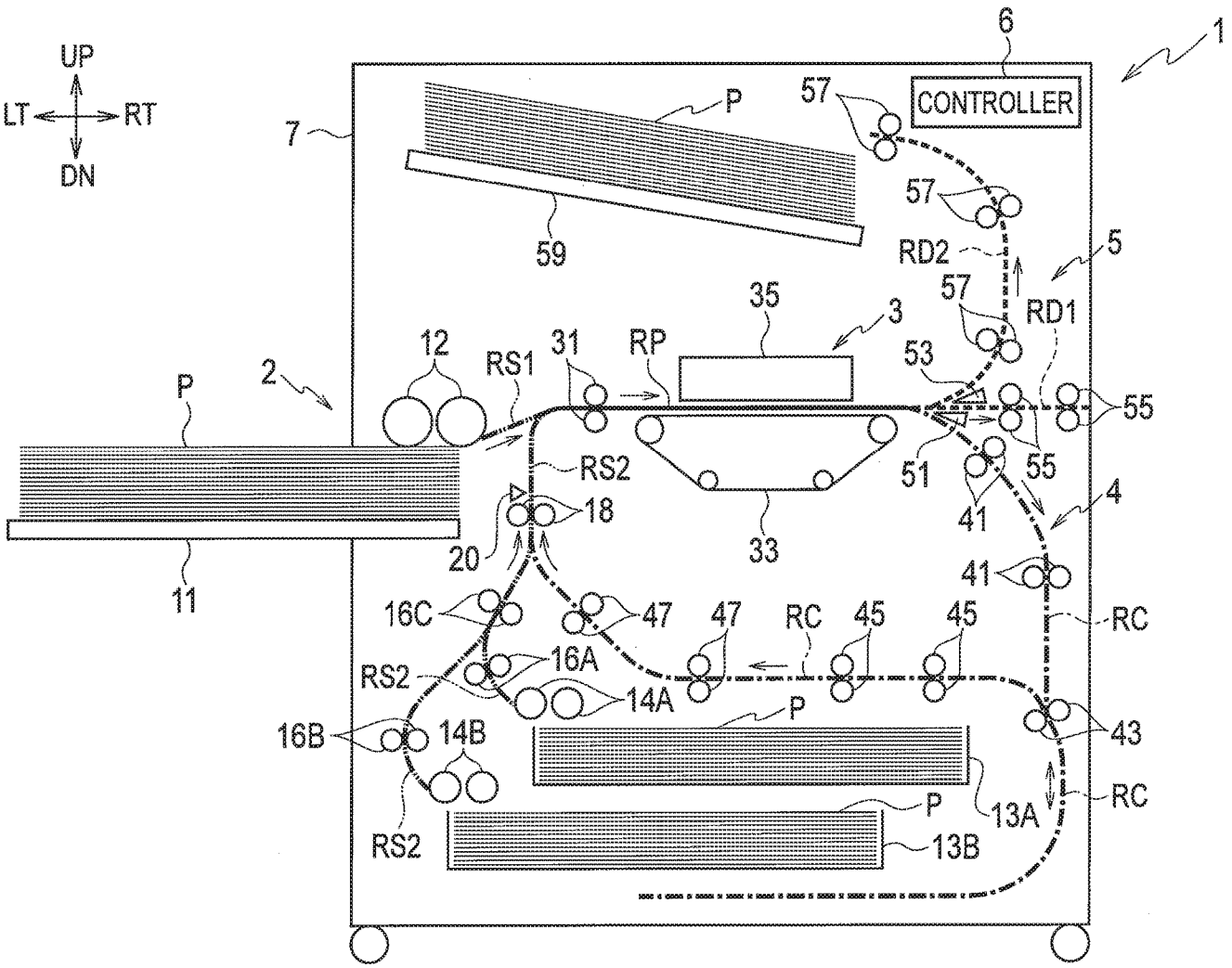
FIG. 1 is a schematic configuration diagram of a printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
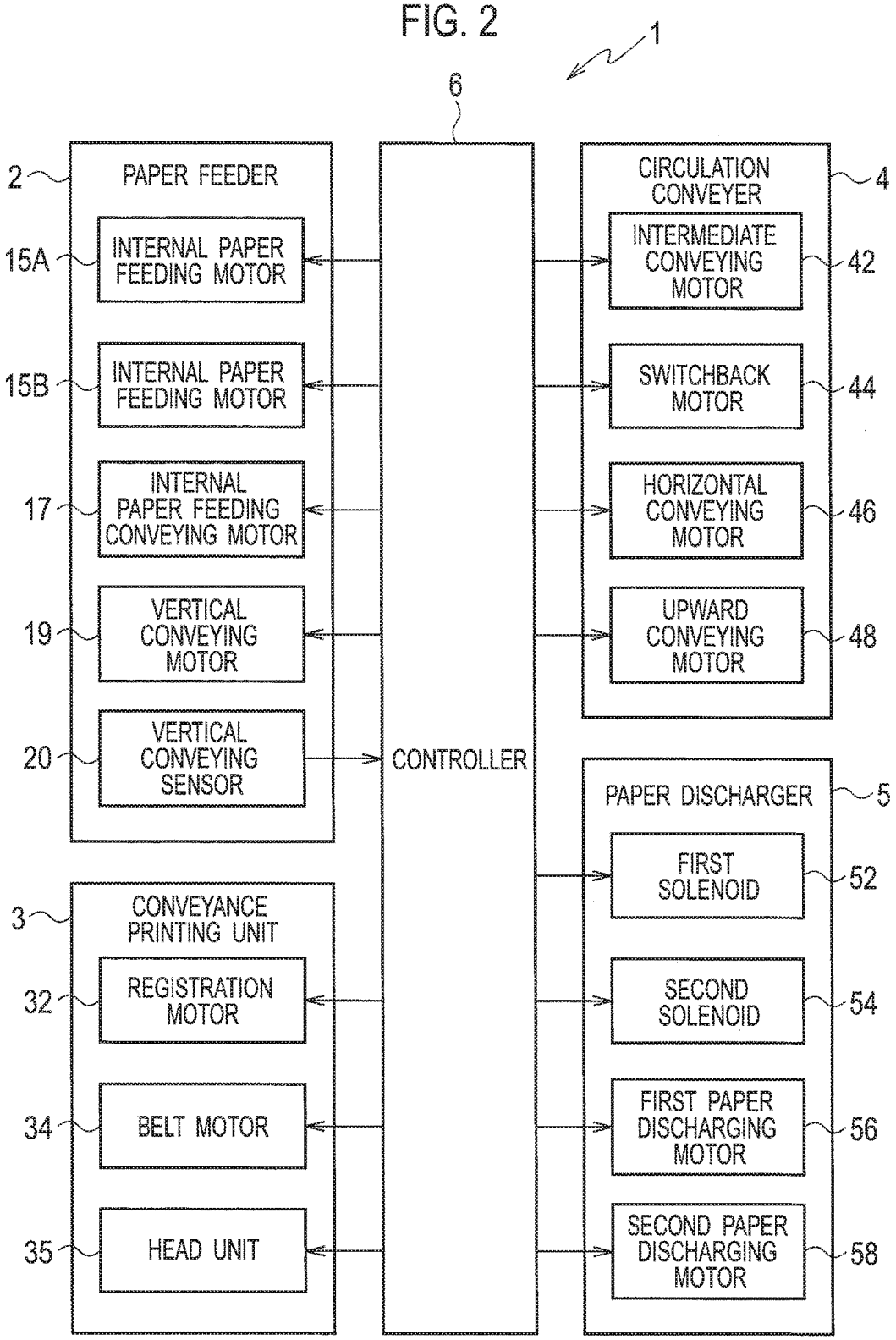
FIG. 2 is a control block diagram of a printer illustrated in FIG. 1.

FIG. 1 is a schematic configuration diagram of a printer in an embodiment. FIG. 2 is a control block diagram of the printer illustrated in FIG. 1. In FIG. 1, directions of right, left, up, and down are denoted by RT, LT, UP, and DN, respectively.

A route illustrated by bold lines in FIG. 1 is a conveying route through which sheets being print media are conveyed. In the conveying route, a route illustrated by a solid line is a printing route RP, a route illustrated by one-dot chain lines is a circulation route RC, routes illustrated by broken lines are a first paper discharging route RD1 and a second paper discharging route RD2, and routes illustrated by two dot chain lines are an external paper feeding route RS1 and an internal paper feeding route RS2. In the following description, upstream and downstream mean upstream and downstream in the conveying route.

As illustrated in FIGS. 1 and 2, a printer 1 of the embodiment includes a paper feeder 2, a conveyance printing unit 3, a circulation conveyer 4, a paper discharger 5, a controller 6, and a case 7 configured to house or hold the aforementioned units. Note that part of the paper feeder 2 (internal paper feeding conveying rollers 16A to 16C to be described later) and part of the circulation conveyer 4 (upward conveying rollers 47 to be described later) form a conveyer.

The paper feeder 2 feeds unprinted sheets P to the conveyance printing unit 3. Moreover, the paper feeder 2 refeeds the sheets P printed on front sides to the conveyance printing unit 3 in duplex printing. The paper feeder 2 is arranged upstream of all the other units in the conveying route. The paper feeder 2 includes an external paper feed tray 11, external paper feeding rollers 12, internal paper feed trays 13A and 13B, internal paper feeding rollers 14A and 14B, internal paper feeding motors 15A and 15B, the internal paper feeding conveying rollers (paper feeding conveyer) 16A to 16C, an internal paper feeding conveying motor 17, vertical conveying rollers (conveying rollers) 18, a vertical conveying motor 19, and a vertical conveying sensor 20.

The external paper feed tray 11 is a tray on which the sheets P used for printing are stacked. The external paper feed tray 11 is installed to be partially exposed to the outside of the case 7.

The external paper feeding rollers 12 pick up the sheets P stacked on the external paper feed tray 11 one by one, and convey the sheets P along the external paper feeding route RS1 to registration rollers 31 of the conveyance printing unit to be described later.

The internal paper feed trays 13A and 13B are trays on which the sheets P used for printing are stacked. The internal paper feed trays 13A and 13B are arranged inside the case 7.

The pairs of internal paper feeding rollers 14A and 14B each pick up the sheets P stacked on a corresponding one of the internal paper feed trays 13A and 13B one by one.

The internal paper feeding motors 15A and 15B rotationally drive the pairs of internal paper feeding rollers 14A and 14B, respectively.

The internal paper feeding conveying rollers 16A and 16B convey the sheets P picked up from the internal paper feed trays 13A and 13B by the internal paper feeding rollers 14A and 14B, to the internal paper feeding conveying rollers 16C. The internal paper feeding conveying rollers 16C convey each of the sheets P conveyed by the internal paper feeding conveying rollers 16A or the internal paper feeding conveying rollers 16B, to the vertical conveying rollers 18. The internal paper feeding conveying rollers 16C are arranged downstream of a point where a portion of the internal paper feeding route RS2 extending from the internal paper feeding rollers 14A and a portion of the internal paper feeding route RS2 extending from the internal paper feeding rollers 14B merge.

The internal paper feeding conveying motor 17 rotationally drives the internal paper feeding conveying rollers 16A to 16C.

The vertical conveying rollers 18 convey the sheets P conveyed from the internal paper feeding conveying rollers 16C along the internal paper feeding route RS2, to the registration rollers 31 of the conveyance printing unit 3 to be described later. Moreover, in the duplex printing, the vertical conveying rollers 18 convey the sheets P printed on the front sides and conveyed and circulated along the circulation route RC, to the registration rollers 31. The vertical conveying rollers 18 are arranged along the internal paper feeding route RS2, downstream of a point where the circulation route RC merges with the internal paper feeding route RS2.

The vertical conveying motor 19 rotationally drives the vertical conveying rollers 18. Moreover, the vertical conveying motor 19 rotationally drives the external paper feeding rollers 12. The vertical conveying motor 19 is connected to each of the pair of the vertical conveying rollers 18 and the pair of the external paper feeding rollers 12 via a not-illustrated one-way clutch. Thus, the vertical conveying rollers 18 are rotationally driven by rotation drive of the vertical conveying motor 19 in one direction, whereas the external paper feeding rollers 12 are rotationally driven by rotation drive of the vertical conveying motor 19 in the other direction.

The vertical conveying sensor 20 detects the sheets P conveyed from the vertical conveying rollers 18 to the registration rollers 31. The vertical conveying sensor 20 is a sensor for detecting a timing at which each sheet P reaches the vertical conveying rollers 18 and a timing at which the sheet P exits the vertical conveying rollers 18. The vertical conveying sensor 20 is arranged at a predetermined position downstream and near the vertical conveying rollers 18.

The conveyance printing unit 3 prints images on the sheets P while conveying the sheets P. The conveyance printing unit 3 is arranged downstream of the paper feeder 2. The conveyance printing unit 3 includes the registration rollers 31, a registration motor 32, a belt conveyer 33, a belt motor 34 and a head unit 35. Note that the belt conveyer 33 and the head unit 35 form a printing unit.

The registration rollers 31 temporarily stop each of the sheets P conveyed by the external paper feeding rollers 12 or the vertical conveying rollers 18 to correct skew of the sheet P and then convey the sheet P to the belt conveyer 33. The registration rollers 31 are arranged in the printing route RP in an upstream portion of the conveyance printing unit 3.

The registration motor 32 rotationally drives the registration rollers 31.

The belt conveyer 33 conveys the sheets P conveyed by the registration rollers 31 while sucking and holding the sheets P on a belt. The belt conveyer 33 is arranged downstream of the registration rollers 31.

The belt motor 34 drives the belt, conveyer 33.

The head unit 35 has multiple line-type inkjet heads (not illustrated) in each of which multiple nozzles are arranged in a direction orthogonal to the conveying direction of the sheets P (front-rear directions). The head unit 35 is arranged above the belt conveyer 33. The head unit 35 prints images by ejecting inks from the nozzles of the inkjet heads onto the sheets P conveyed by the belt conveyer 33.

The circulation conveyer 4 conveys the sheets P printed on the front sides along the circulation route RC and transfers the turned-over sheets P to the vertical conveying rollers 18 in the duplex printing. The circulation conveyer 4 includes multiple pairs of intermediate conveying rollers 41, an intermediate conveying motor 42, switchback rollers 43, a switchback motor 44, multiple pairs of horizontal conveying rollers 45, a horizontal conveying motor 46, multiple pairs of upward conveying rollers (paper refeeding conveyer) 47, and an upward conveying motor 48.

The intermediate conveying rollers 41 convey the sheets P printed on the front sides, to the switchback rollers 43 in the duplex printing. The multiple pairs of intermediate conveying rollers 41 are arranged along a portion of the circulation route RC between the conveyance printing unit 3 and the switchback rollers 43.

The intermediate conveying motor 42 rotationally drives the multiple pairs of intermediate conveying rollers 41. Moreover, the intermediate conveying motor 42 rotationally drives the most upstream pair of first paper discharging rollers 55 and pairs of second paper discharging rollers 57 except for the most downstream pair of the second paper discharging rollers 57 to be described later.

The switchback rollers 43 switch back the sheets P conveyed by the intermediate conveying rollers 41 and convey the sheets P to the horizontal conveying rollers 45. The switchback rollers 43 are arranged downstream of the intermediate conveying rollers 41, in the circulation route RC.

The switchback motor 44 rotationally drives the switchback rollers 43.

The horizontal conveying rollers 45 convey the sheets P switched back by the switchback rollers 43, to the upward conveying rollers 47. The multiple pairs of horizontal conveying rollers 45 are arranged along an upstream portion of the circulation route RC between the pair of switchback rollers 43 and the point where the circulation route RC merges with the internal paper feeding route RS2.

The horizontal conveying motor 46 rotationally drives the multiple pairs of horizontal conveying rollers 45.

The upward conveying rollers 47 convey the sheets P conveyed by the horizontal conveying rollers 45, to the vertical conveying rollers 18. The multiple pairs of upward conveying rollers 47 are arranged along a downstream portion of the circulation route RC between the pair of switchback rollers 43 and the point where the circulation route RC merges with the internal paper feeding route RS2.

The upward conveying motor 48 rotationally drives the multiple pairs of upward conveying rollers 47.

The paper discharger 5 discharges the printed sheets P. The paper discharger 5 includes a first switching unit 51, a first solenoid 52, a second switching unit 53, a second solenoid 54, the multiple pairs of first paper discharging rollers 55, a first paper discharging motor 56, the multiple pairs of second paper discharging rollers 57, a second paper discharging motor 58, and a paper receiving tray 59.

The first switching unit 51 switches the conveying route of the sheets P from the first paper discharging route RD1 to the circulation route RC and vice versa. The first paper discharging route RD1 is a route extending from a downstream end of the printing route RP toward a post-processing device (not illustrated) arranged to the right of the printer 1. The first switching unit 51 is arranged at a branching point between the first paper discharging route RD1 and the circulation route RC.

The first solenoid 52 drives the first switching unit 51.

The second switching unit 53 switches the conveying route of the sheets P from the first paper discharging route RD1 to the second paper discharging route RD2 and vice versa. The second paper discharging route RD2 is a route which branches from the first paper discharging route RD1 at a position downstream of the branching point between the first paper discharging route RD1 and the circulation route RC and extends to the paper receiving tray 59. The second switching unit 53 is arranged at a branching point where the second paper discharging route RD2 branches from the first paper discharging route RD1.

The second solenoid 54 drives the second switching unit 53.

The first paper discharging rollers 55 discharge the sheets P conveyed from the conveyance printing unit 3, to the post-processing device. The multiple pairs of first paper discharging rollers 55 are arranged along the first paper discharging route RD1.

The first paper discharging motor 56 rotationally drives the first paper discharging rollers 55 except for the most upstream pair of first paper discharging rollers 55. The most upstream pair of first paper discharging rollers 55 is rotationally driven by the intermediate conveying motor 42.

The second paper discharging rollers 57 discharge the sheets P conveyed from the conveyance printing unit 3, to the paper receiving tray 59. The multiple pairs of second paper discharging rollers 57 are arranged along the second paper discharging route RD2.

The second paper discharging motor 58 rotationally drives the most downstream pair of second paper discharging rollers 57. The second paper discharging rollers 57 except for the most downstream pair of second paper discharging rollers 57 are rotationally driven by the intermediate conveying motor 42.

The paper receiving tray 59 is a tray on which the sheets P discharged by the second paper discharging rollers 57 are stacked. The paper receiving tray 59 is arranged at a downstream end of the second paper discharging route RD2.

The controller 6 controls operations of the units in the printer 1. The controller 6 includes a CPU, a RAM, a ROM, a hard disk drive, and the like.

Specifically, the controller 6 performs control such that the sheet P is fed to the conveyance printing unit 3 by the paper feeder 2 and is printed in the conveyance printing unit 3 by ejecting the inks from the head unit 35 while the sheet P is conveyed by the belt conveyer 33. In the duplex printing, the controller 6 performs control such that the sheet P printed on the front side is turned over by the circulation conveyer 4, conveyed to the vertical conveying rollers 18 of the paper feeder 2, and refed to the conveyance printing unit 3 by the vertical conveying rollers 18 to be subjected to back-side printing. The controller 6 performs control such that the printed sheet P is discharged by the paper discharger 5.

In the feeding and the refeeding in the duplex printing, the controller 6 controls the paper feeder 2 in such a way that the sheet P is stopped while abutting on the registration rollers 31. Then, the controller 6 controls the registration rollers 31 such that the abutting sheet P is conveyed to the belt conveyer 33 at a set sheet interval Lg.

Moreover, in the cases of performing the simplex printing or the duplex printing by feeding the sheets P from the internal paper feed trays 13A and 13B, the controller 6 performs conveying speed control of the vertical conveying rollers 18, based on a time from a timing at which a preceding sheet P exits the vertical conveying rollers 18 to a timing at which a following sheet P reaches the vertical conveying rollers 18.

Next, operations of the printer 1 in the simplex printing are described.

When the simplex printing is started, the unprinted sheets P are fed from the paper feeder 2 to the conveyance printing unit 3 one by one. In the conveyance printing unit 3, each of the sheets P abuts on the registration rollers 31 to be subjected to the skewing correction and is then conveyed to the belt conveyer 33 by the registration rollers 31 at a timing corresponding to a sheet length Lp, the sheet interval Lg, and a printing conveying speed. Va. Then, the sheet P is printed by using the inks ejected from the inkjet heads of the head unit 35 while being conveyed by the belt conveyer 33 at the printing conveying speed Vg.

The sheet length Lp is the length of the sheet P in the conveying direction. The sheet length Lp is a value determined based on the sheet size.

The sheet interval Lg is a distance between a trailing edge of a preceding sheet P and a leading edge of a following sheet P in the belt conveyer 33. The shorter the sheet interval Lg is, the greater the number of sheets outputted per unit time is. In the embodiment, the sheet interval Lg is set to a smallest value achievable under the conditions such as the performance of the inkjet heads of the head unit 35, in order to achieve high productivity.

The printing conveying speed Vg is a conveying speed of the belt conveyer 33 in the printing performed by the conveyance printing unit 3. The printing conveying speed Vg is set based on parameters such as the printing resolution and the maximum number of drops for one pixel which is determined depending on the sheet type and the like.

The sheet P printed in the conveyance printing unit 3 is discharged by the paper discharger 5. When the printed sheet P is to be discharged to the post-processing device, the printed sheet P is guided to the first paper discharging route RD1 by the first switching unit 51 and the second switching unit 53. Then, the sheet P is discharged to the post-processing device by the first paper discharging rollers 55. Meanwhile, when the printed sheet P is to be discharged to the paper receiving tray 59, the printed sheet P is guided to the second paper discharging route RD2 by the first switching unit 51 and the second switching unit 53. Then, the sheet P is discharged to the paper receiving tray 59 by the second paper discharging rollers 57.

A printing time Tps for one sheet in the conveyance printing unit 3 in the simplex printing as described above can be expressed by the following formula (1).

$$Tps=(Lp+Lg)/Vg \quad (1)$$

Since the printing is performed at the productivity of the printing time Tps for one sheet, the registration rollers 31 operate in such a way as to be activated every printing time Tps and stopped when conveying the sheet P by a distance corresponding to the sheet length Lp.

Next, description is given of conveying speed control of the vertical conveying rollers 18 in the simplex printing in which the sheets P are fed from the internal paper feed trays 13A and 13B.

Figure 3:
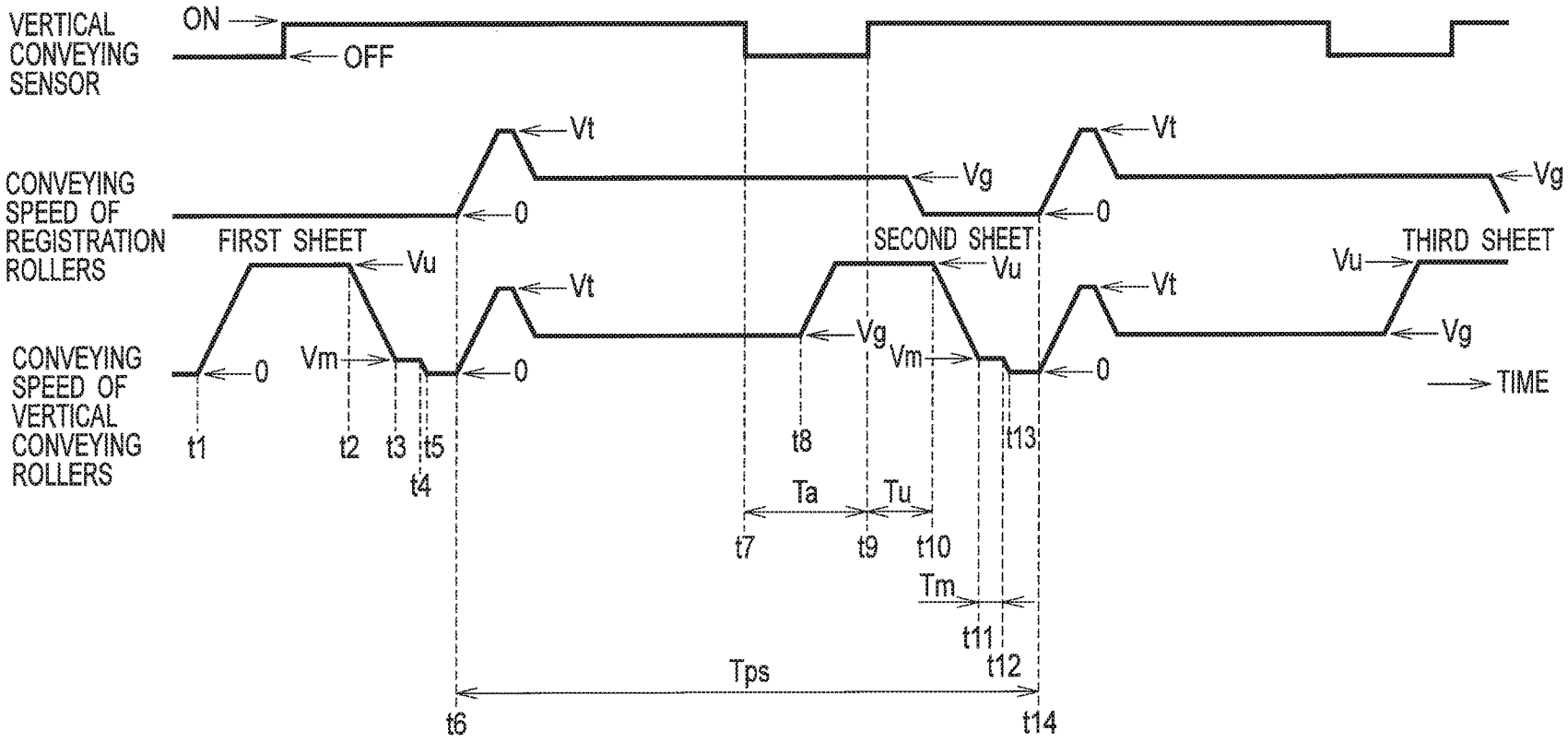
FIG. 3 is a timing chart for explaining conveying speed control of vertical conveying rollers in simplex printing in which sheets are fed from internal paper feed trays.

FIG. 3 is a timing chart for explaining the conveying speed control of the vertical conveying rollers 18 in the simplex printing in which the sheets P are fed from the internal paper feed trays 13A and 13B.

After reception of a print job, the controller 6 causes the vertical conveying motor 19 to activate the vertical conveying rollers 18 at a time point t1 of FIG. 3 to feed the first sheet. When the conveying speed of the vertical conveying rollers 18 reaches a receiving speed Vu, the controller 6 causes the vertical conveying rollers 18 to maintain the receiving speed Vu.

The receiving speed Vu is a conveying speed at which the vertical conveying rollers 18 receive the sheets P from the internal paper feeding conveying rollers 16C, the sheets P picked up and conveyed from the internal paper feed trays 13A and 13B. The receiving speed Vu is set to a speed corresponding to an internal paper feeding conveying speed which the conveying speed of the internal paper feeding conveying rollers 16A to 16C.

The internal paper feeding conveying speed varies depending on the paper feed tray serving as the paper feeding source. The internal paper feeding conveying speed in the case where the paper feeding source is the internal paper feed tray 13A is referred to as Vka, and the internal paper feeding conveying speed in the case where the paper feeding source is the internal paper feed tray 13B is referred to as Vkb. In this case, Vkb>Vka is satisfied. This is because the internal paper feed tray 13B is farther away from the vertical conveying rollers 18 than the internal paper feed tray 13A is.

When the paper feeding source is the internal paper feed tray 13, the receiving speed Vu of the vertical conveying rollers 18 is equal to Vka. When the paper feeding source is the internal paper feed tray 13B, the receiving speed Vu is equal to Vkb.

After the conveying speed of the vertical conveying rollers 18 reaches the receiving speed Vu, the vertical conveying rollers 18 receive each sheet P conveyed by the internal paper feeding conveying rollers 16A to 16C at the receiving speed Vu and convey the sheet P.

After the vertical conveying rollers 18 receive the sheet P, the controller 6 starts deceleration of the vertical conveying rollers 18 at a time point t2. When the vertical conveying rollers 18 are decelerated to an abutting speed Vm at a time point t3, the controller 6 causes the vertical conveying rollers 18 to maintain the abutting speed Vm until the sheet P is conveyed by an abutting conveying distance Lmk from the time point t3.

When the conveying distance at the abutting speed yin reaches the abutting conveying distance Lmk at a time point t4, the controller 6 starts deceleration of the vertical conveying rollers 18 to stop the vertical conveying rollers 18. Then, at a time point t5, the vertical conveying rollers 18 are stopped.

The abutting speed Vm is a conveying speed at which the sheet P abuts on the registration rollers 31. The abutting speed Vm is slower than the internal paper feeding conveying speeds Vka and Vkb. This can suppress colliding noise of the sheet P. The abutting speed Vm is a value set in advance.

The abutting conveying distance Lmk is a distance by which the sheet P is conveyed at the abutting speed Vm to perform the skewing correction in which the sheet P abuts on the registration rollers 31 and a slack is formed in the sheet P. The abutting conveying distance Lmk is a value set in advance.

Figure 4:
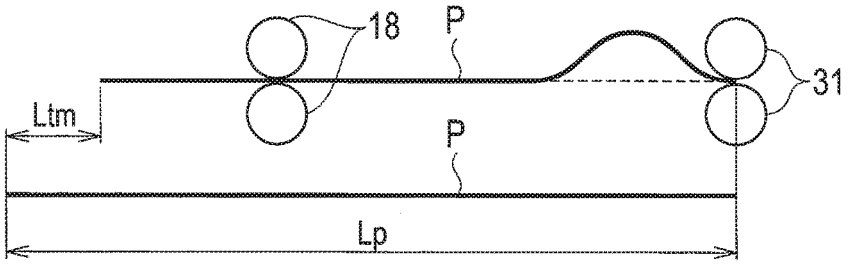
FIG. 4 is a view for explaining a slack amount.

The timing (time point t2) of the start of the deceleration of the vertical conveying rollers 18 from the receiving speed Vu is determined such that the vertical conveying rollers 18 can be stopped with a slack of a slack amount Ltm formed in the sheet. P. The slack amount Ltm is a decrease amount from the sheet length Lp in the case where the sheet P abuts on the registration rollers 31 with a slack formed therein as illustrated in FIG. 4. Note that, in FIG. 4, the registration rollers 31 and the vertical conveying rollers 18 are illustrated to be provided in a linear route for the convenience of description. The slack amount Ltm is a value set to an appropriate amount in advance.

After the stop of the vertical conveying rollers 18, at a time point t6, the controller 6 causes the registration motor 32 to activate the registration rollers 31. After the activation of the registration rollers 31, the controller 6 accelerates the conveying speed of the registration rollers 31 to a top speed Vt, causes the registration rollers 31 to maintain the top speed Vt for a predetermined time, and decelerates the conveying speed of the registration rollers 31 to the printing conveying speed Vg. Then, the controller 6 causes the registration rollers 31 to maintain the printing conveying speed Vg. The controller 6 decelerates the registration rollers 31 to the printing conveying speed Vg before the leading edge of the sheet P reaches the belt conveyer 33. The top speed Vt is a value set in advance.

Moreover the controller 6 activates the vertical conveying rollers 18 at the time point t6 to assist the registration rollers 31. Thereafter, the controller 6 accelerates the vertical conveying rollers 18 to the top speed Vt and then decelerates the vertical conveying rollers 18 to the printing conveying speed Vg in synchronization with the registration rollers 31.

When the first sheet P exits the vertical conveying rollers 18 after the registration rollers 31 and the vertical conveying rollers 18 decelerate to the printing conveying speed Vg, the controller 6 starts measuring a time that elapses before the second sheet P reaches the vertical conveying rollers 18. Specifically, the controller 6 starts measuring the time at a time point t7 at which the vertical conveying sensor 20 detects the trailing edge of the first sheet.

Thereafter, at a time point t8, the controller 6 starts acceleration of the vertical conveying rollers 18 from the printing conveying speed Vg. Then, when the conveying speed of the vertical conveying rollers 18 reaches the receiving speed Vu, the controller 6 causes the vertical conveying rollers 18 to maintain the receiving speed Vu.

When the second sheet. P reaches the vertical conveying rollers 18, the vertical conveying rollers 18 receive the sheet P at the receiving speed Vu and convey the sheet P. In this case, when the second sheet P reaches the vertical conveying rollers 18 and the leading edge of the sheet P is detected by the vertical conveying sensor 20, the controller 6 calculates a receiving speed duration time Tu and an abutting speed conveying time Tm, based on a measurement time Ta from the time point t7 to a time point t9 which is the time point of the detection. Methods of calculating the receiving speed duration time Tu and the abutting speed conveying time Tm are described later.

At time point t10, that is, upon elapse of the receiving speed duration time Tu from the time point t9, the controller 6 starts deceleration of the vertical conveying rollers 18. When the vertical conveying rollers 18 are decelerated to the abutting speed. Vm at a time point t11, the controller 6 causes the vertical conveying rollers 18 to maintain the abutting speed Vm for the abutting speed conveying time Tm from the time point t11.

At a time point t12, that is, upon elapse of the abutting speed conveying time Tm from the time point t11, the controller 6 starts deceleration of the vertical conveying rollers 18 to stop the vertical conveying rollers 18. Then, at a time point t13, the vertical conveying rollers 18 are stopped.

Meanwhile, the controller 6 stops the registration rollers 31 after the first sheet P exits the registration rollers 31. A timing at which the registration rollers 31 are stopped is set depending on the sheet length Lp.

Then, at a time point t14, that is, upon elapse of the printing time Tps from the activation timing (time point t6) of the registration rollers 31 in the feeding of the first sheet, the controller 6 activates the registration rollers 31 to send the second sheet P to the belt conveyer 33. Moreover, along with this, the controller 6 activates the vertical conveying rollers 18 to assist the registration rollers 31. Thereafter, operations in a period from the time point t6 to the time point t14 are repeated. However, in the feeding of the last sheet P, the controller 6 stops the vertical conveying rollers 18 when the trailing edge of the sheet P is detected by the vertical conveying sensor 20.

Next, description is given of the methods of calculating the receiving speed duration time Tu and the abutting speed conveying time Tm.

The receiving speed duration time Tu is a time from the detection, by the vertical conveying sensor 20, of the sheet P reaching the vertical conveying rollers 18 to the start of deceleration from the receiving speed Vu to the abutting speed Vm in the conveying speed control of the vertical conveying rollers 18 based on the measurement time Ta.

The abutting speed conveying time Tm is a conveying time at the abutting speed Vm in the conveying speed control of the vertical conveying rollers 18 based on the measurement time Ta.

The measurement time Ta is a measurement result of the time from the timing at which the preceding sheet P exits the vertical conveying rollers 18 to the timing at which the following sheet P reaches the vertical conveying rollers 18. The timing at which the sheet P exits the vertical conveying rollers 18 is a timing at which a certain time determined depending on the sheet length Lp elapses from the activation of the registration rollers 31. Accordingly, the timing at which the sheet P exits the vertical conveying rollers 18 can be used as a reference for measuring a degree of delay relative to a theoretical timing at which the following sheet P reaches the vertical conveying rollers 18. In other words, the measurement time Ta indicates the degree of delay of the timing at which the following sheet P reaches the vertical conveying rollers 18.

The receiving speed duration time Tu and the abutting speed conveying time Tm are calculated such that the vertical conveying rollers 18 can convey the sheet P by a specified conveying amount L with a specified minimum stopping time Ts remaining before the activation timing of the registration rollers 31, after the vertical conveying sensor 20 detects the sheet P reaching the vertical conveying rollers 18. The specified minimum stopping time Ts is a value set in advance as a minimum time required between the completion timing of the abutting operation of the vertical conveying rollers 18 and the activation timing of the registration rollers 31.

The specified conveying amount L is a conveying amount for stopping the sheet P with the sheet P abutting on the registration rollers 31 and with a slack of the slack amount Ltm formed in the sheet P. Specifically, the specified conveying amount L is expressed by the following formula (2).

$$L=Lv+Ltm \tag{2}$$

in this formula, Lv is a distance between the vertical conveying sensor 20 and the pair of registration rollers 31 in the conveying route.

When the conveyance of the sheet P by the specified conveying amount L with a specified minimum stopping time Ts remaining before the activation timing of the registration rollers 31 is possible with the conveying distance at the abutting speed Vm set to the abutting conveying distance Lmk which is a fixed value, the conveying distance at the abutting speed Vm is set to the abutting conveying distance Lmk.

Figure 5:
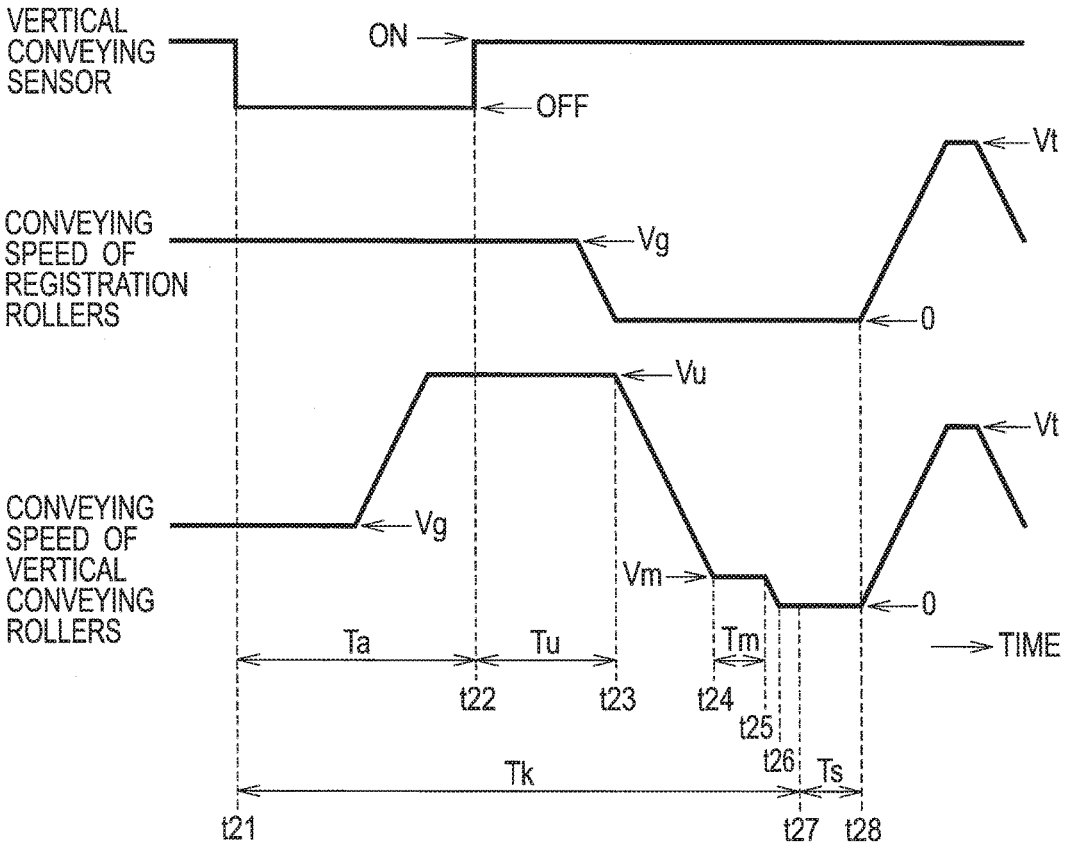
FIG. 5 is a view for explaining a method of calculating a receiving speed duration time and an abutting speed conveying time.

As illustrated in FIG. 5, Tk denotes a time from a timing (time point 21) at which the sheet P exits the vertical conveying rollers 18 to a timing (time point t27) at which the specified minimum stopping time Ts remains to the activation timing of the registration rollers 31. When the conveyance of the sheet P by the specified conveying amount L with a specified minimum stopping time Ts remaining before the activation timing of the registration rollers 31 is possible with the conveying distance at the abutting speed Vm set to the abutting conveying distance Lmk, the abutting operation of the vertical conveying rollers 18 is completed before a timing (time point t27) at which a period corresponding to the time Tk ends as illustrated in FIG. 5.

Accordingly, the following formula (3) is satisfied in this case. To put it another way, when the formula (3) is satisfied, the conveying distance at the abutting speed Vm is set to the abutting conveying distance Lmk which is a fixed value.

[Math 1]

$$Ta \leq Tk-((L-Vu^2/2|\alpha d|-Lmk)/Vu+Lmk/Vm+Vu/|\alpha d|) \tag{3}$$

Moreover, the receiving speed duration time Tu and the abutting speed conveying time Tm are calculated by using the following formulae (4) and (5)

$$Tu=(L-Vu^2/2|\alpha d|-Lmk)/Vu \tag{4}$$

$$Tm=Lmk/Vm \tag{5}$$

In this formula, ad is the acceleration of the vertical conveying rollers 18 in the case where the vertical conveying rollers 18 are decelerated, ad is a fixed value.

$Vu^2/2|\alpha d|$ in the formulae (3) and (5) is a total of a conveying distance in a period from the start of deceleration from the receiving speed Vu (time point t23) to the conveying speed reaching the abutting speed Vm (time point t24) and a conveying distance in a period from the start of deceleration from the abutting speed Vm (time point t25) to the stop (time point t26) "$L-Vu^2/2|\alpha d|-Lmk$" is a conveying distance in a period from a time point at which the sheet P reaches the vertical conveying sensor 20 (time point t22) to the start of deceleration from the receiving speed Vu (time point t23).

Moreover, $Vu/|\alpha d|$ in the formula (3) is a total of a time from the start of deceleration from the receiving speed Vu (time point t23) to the conveying speed reaching the abutting speed Vm (time point t24) and a time from the start of deceleration from the abutting speed Vm (time point t25) to the stop (time point t26).

Figure 6:
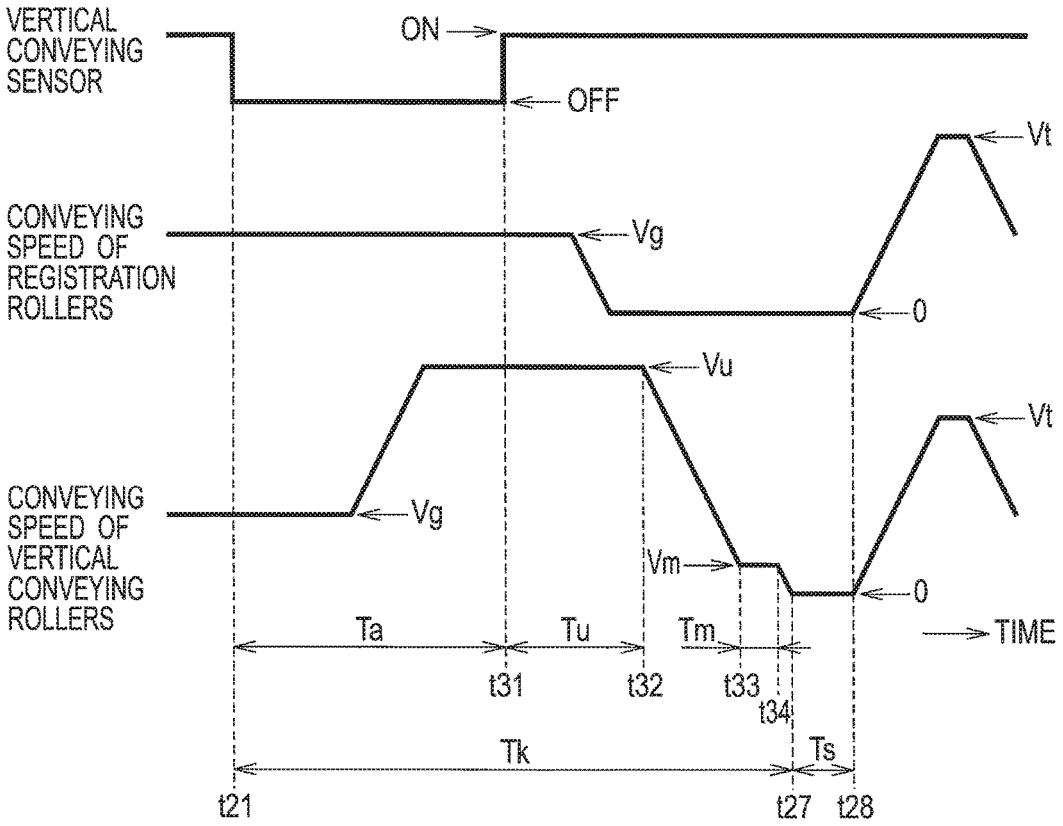
FIG. 6 is a view for explaining the method of calculating the receiving speed duration time and the abutting speed conveying time.

Meanwhile, when the formula (3) is not satisfied, the conveying distance at the abutting speed Vm is set to a distance shorter than the abutting conveying distance Lmk. Then, as in FIG. 6, the abutting operation of the vertical conveying rollers 18 is terminated at the timing (time point t27) at which the period corresponding to the time Tk ends.

In this case, the following formulae (6) to (9) are established.

$$Tu+Tm+Vu/|\alpha d|=Tk-Ta \tag{6}$$

$$Tu=Lu/Vu \tag{7}$$

$$Tm=Lmh/Vm \tag{8}$$

$$Lmh=L-Vu^2/2|\alpha d|-Lu \tag{9}$$

In these formulae, Lu is a conveying distance in a period from the time point at which the sheet P reaches the vertical conveying sensor 20 (time point t31) to the start of the deceleration from the receiving speed Vu (time point t32). Lmh is a corrected abutting conveying distance. The corrected abutting conveying distance Lmh is a conveyance distance at the abutting speed Vm in the case where the formula (3) is not satisfied. The corrected abutting conveying distance Lmh is shorter than the abutting conveying distance Lmk.

The receiving speed duration time Tu and the abutting speed conveying time Tm are expressed by the following formulae (10) and (11), respectively, from the formulae (6) to (9).

[Math 2]

$$Tu=(Tk-Ta-Vu/|\alpha d|-(L-Vu^2/2|\alpha d|)/Vm)/(1-Vu/Vm) \tag{10}$$

$$Tm=((L-Vu^2/2|\alpha d|)/Vu-(Tk-Ta-Vu/|\alpha d|))/(Vm/Vu-1) \tag{11}$$

The receiving speed duration time Tu and the abutting speed conveying time Tm in the case where the formula (3) is not satisfied are calculated from the formulae (10) and (11).

In this case, when the abutting speed conveying time Tm expressed by the formula (11) is 0 (zero), the vertical conveying rollers 18 are monotonically decelerated from the receiving speed Vu at the deceleration of ad and are stopped. The measurement time Ta in this case is the maximum value of the measurement time Ta within a range in which the sheet P can be conveyed by the specified conveying amount L with a specified minimum stopping time Ts remaining before the activation timing of the registration rollers 31. Ta_max which is the maximum value of the measurement time Ta is expressed by the following formula (12).

$$Ta_max=Tk-(L-Vu^2/2|\alpha d|)/Vu-Vu/|\alpha d| \tag{12}$$

In the case where Ta>Ta_max is satisfied, the printer 1 determines that jamming of the sheet P has occurred, and the operation of the printer 1 is stopped.

When the sheet size of the sheets P stacked on the internal paper feed tray 13A and that on the internal paper feed tray 133 are different from each other, the simplex printing is sometimes performed with sheets of different sizes mixedly existing. In this case, the receiving speed Vu is equal to Vka when the sheets P are fed from the internal paper feed tray 13A, while the receiving speed Vu is equal to Vkb when the sheets P are fed from the internal paper feed tray 13B.

In this case, the sheet interval Lg is constant also when sheets of different sizes mixedly exist. Accordingly, the time (Tk+Ts) from the timing at which the preceding sheet P exits the vertical conveying rollers 18 to the activation timing of the registration rollers 31 in the feeding of the following sheet P is constant as in the printing of sheets of the same size. Moreover, the measurement time Ta is independent of the sheet size.

Accordingly, in the simplex printing in which sheets of different sizes mixedly exist, it is only necessary to obtain the measurement time Ta, calculate the receiving speed duration time Tu and the abutting speed conveying time Tm by using formulae (4), (5), (10), and (11), and perform the conveying speed control of the vertical conveying rollers 18 by using the result of the calculation.

Moreover, when the sheet size of the sheets P stacked on the internal paper feed tray 13A and that on the internal paper feed tray 13B are the same, the paper feeding source is sometimes switched between the internal paper feed trays 13A and 13B due to running-out of sheets during printing. In this case, the receiving speed Vu of the vertical conveying rollers 18 is switched between Vka and Vkb in the switching of the paper feeding source. The sheet interval Lg is constant also in this case. Accordingly, also in this switching, it is only necessary to obtain the measurement time Ta, calculate the receiving speed duration time Tu and the abutting speed conveying time Tm by using formulae (4), (5), (10), and (11), and perform the conveying speed control of the vertical conveying rollers 18 by using the result of the calculation.

When the sheets P are fed from the external paper feed tray 11, the controller 6 causes the external paper feeding rollers 12 to convey the sheets P while picking up the sheets P from the external paper feed tray 11. Then, the controller 6 controls the external paper feeding rollers 12 such that each sheet P abuts on the registration rollers 31 at the abutting speed Vm and is stopped with a slack of the slack amount Ltm formed.

Thereafter, the controller 6 activates the registration rollers 31 and also starts an assisting operation of the external paper feeding rollers 12. Specifically, the controller 6 activates the external paper feeding rollers 12 simultaneously with the registration rollers 31 and accelerates the external paper feeding rollers 12 at an acceleration smaller than that of the registration rollers 31. This gradually reduces the slack in the sheet P while the sheet P is conveyed. Then, the controller 6 starts deceleration of the external paper feeding rollers 12 at a timing at which the slack in the sheet P is absorbed, and then stops the external paper feeding rollers 12. The assisting operation is thereby completed. Since the external paper feeding rollers 12 are configured to convey the sheet P while picking up the sheet P from the external paper feed tray 11, the controller 6 performs control such that the assisting operation is completed before the trailing edge of the sheet P exits the external paper feeding rollers 12, to prevent erroneous pick up of the next sheet P.

Next, the printing schedule of the conveyance printing unit 3 in the duplex printing is described.

The printing schedule of the conveyance printing unit 3 in the duplex printing is a schedule for achieving productivity for one side equivalent to that in the simplex printing, in an interleaving method. The interleaving method is a method in which front sides of unprinted sheets P and back sides of sheets P printed on front sides are alternately printed while multiple sheets P are conveyed in the conveying route. Note that the duplex printing is assumed to be performed for sheets of the same size.

Figure 7:
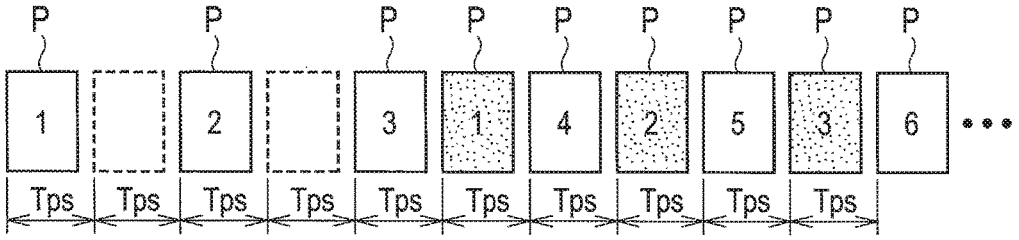
FIG. 7 is a view for explaining a printing schedule of a printing unit in duplex printing.

Specifically, as shown in FIG. 7, in the printing schedule in the duplex printing, the front-side printing and the back-side printing are performed alternately with one side printed in the printing time Tps. In FIG. 7, the numbers inside the sheets P indicate the order of the sheets. Moreover, white sheets P are sheets to be printed on the front sides and sheets P shaded by dots are sheets to be printed on the back sides.

Note that, until the first sheet P printed on the front side is refed and subjected to the back-side printing, the front-side printing is performed consecutively. In this period, as illustrated in FIG. 7, a gap of the printing time Tps for one sheet is generated between the printing of the preceding sheet P and the printing of the following sheet P. Moreover, after the front-side printing of the last sheet P, the back-side printing is performed consecutively. Also in this period, a gap of the printing time Tps for one sheet is generated between the printing of the preceding sheet P and the printing of the following sheet P. Accordingly, the productivity for one side equivalent to that in the simplex printing is substantially achieved in a period when the front-side printing and the back-side printing are performed alternately. The number of sheets subjected to the front side printing consecutively before the first sheet is refed and subjected to the back-side printing is determined depending on the sheet length Lp.

Next, operations of the printer 1 in the duplex printing are described.

When the duplex printing is started, the unprinted sheets P are sequentially fed from the paper feeder 2 to the conveyance printing unit 3 every 2Tps. In the conveyance printing unit 3, each sheet P abuts on the registration rollers 31 to be subjected to skewing correction and is conveyed to the belt conveyer 33 by the registration rollers 31 at a timing corresponding to the printing schedule. Then, the sheet P is subjected to the front-side printing by using the inks ejected from the inkjet heads of the head unit 35 while being conveyed by the belt conveyer 33 at the printing conveying speed Vg.

The sheet P printed on the front side is guided to the circulation route RC by the first switching unit 51 and is conveyed to the switchback rollers 43 by the intermediate conveying rollers 41. Then, the sheet P is turned over by being switched back by the switchback rollers 43. The switched back sheet P is conveyed to the vertical conveying rollers 18 at a reverse conveying speed Vr by the horizontal conveying rollers 45 and the upward conveying rollers 47. The reverse conveying speed Vr is set such that the sheet. P can be refed at a timing corresponding to the printing schedule of the conveyance printing unit 3. The reverse conveying speed Vr is a speed different from the internal paper feeding conveying speeds Vka and Vkb of the internal paper feeding conveying rollers 16A to 16C.

Next, the sheet. P printed on the front side is made to abut on the registration rollers 31 by the vertical conveying rollers 18 and is subjected to the skewing correction. Then, the sheet P is conveyed to the belt, conveyer 33 by the registration rollers 31 at a timing corresponding to the printing schedule. In this case, since the sheet P is turned over by the switchback rollers 43, the back side (unprinted side) of the sheet P faces upward and the sheet P is subjected to the back-side printing by using the inks ejected from the head unit 35 while being conveyed by the belt conveyer 33 at the printing conveying speed Vg. Then, the sheet P printed on both sides is discharged by the paper discharger 5.

In the period in which the front-side printing and the back-side printing are performed alternately in the duplex printing as described above, the registration rollers 31 operate in such a way as to be activated every printing time Tps and stopped when conveying the sheet P by a distance corresponding to the sheet length Lp as in the simplex printing described above. In the period in which the front-side printing or the back-side printing is performed consecutively, the registration rollers 31 operate in such a way as to be activated every 2Tps and stopped when the conveying the sheet P by a distance corresponding to the sheet length Lp.

Then, in the duplex printing in which the sheets P are fed from the internal paper feed trays 13A and 13B, the controller 6 performs the conveying speed control of the vertical conveying rollers 18 based on the measurement time Ta as in the simplex printing described above.

In this case, in the period in which the front-side printing and the back-side printing are performed alternately, the sheets P are conveyed to the vertical conveying rollers 18 alternately from the internal paper feeding conveying rollers 16C and the circulation conveyer 4. The receiving speed Vu of the unprinted sheets P conveyed from the internal paper feeding conveying rollers 16C is Vka or Vkb. The receiving speed Vu of the sheets P printed on the front sides and conveyed from the circulation conveyer 4 is equal to yr.

As described above, in the period in which the front-side printing and the back-side printing are performed alternately, the sheets P are conveyed to the vertical conveying rollers 18 through the different routes at the different conveying speeds. However, the sheet interval Lg in the conveyance printing unit 3 is constant. Accordingly, the time (Tk+Ts) from the timing at which the preceding sheet P exits the vertical conveying rollers 18 to the activation timing of the registration rollers 31 in the feeding of the following sheet P is constant as in the simplex printing described above.

In the period in which the front-side printing or the back-side printing is performed consecutively, the sheet interval is longer than that in the period in which the front-side printing and the back-side printing are performed alternately, by a distance corresponding to the printing time Tps for one sheet. Specifically, the sheet interval is (Lp+2Lg) Note that the sheet interval is constant in this period. Accordingly, the time (Tk+Ts) from the timing at which the preceding sheet P exits the vertical conveying rollers 18 to the activation timing of the registration rollers 31 in the feeding of the following sheet. P is also constant.

The controller 6 thus obtains the measurement time Ta, calculates the receiving speed duration time Tu and the abutting speed conveying time Tm by using formulae (4), (5), (10), and (11), and performs the conveying speed control of the vertical conveying rollers 18 by using the result of the calculation as in the simplex printing. Note that the controller 6 only needs to perform the conveying speed control of the vertical conveying rollers 18 based on the measurement time Ta as in the simplex printing described above also in the case where the paper feeding source is switched between the internal paper feed trays 13A and 13B.

As described above, in the printer 1, when the printing is performed with the sheets P fed from the internal paper feed trays 13A and 135, the controller 6 measures the time from the timing at which the preceding sheet P exits the vertical conveying rollers 18 to the timing at which the following sheet P reaches the vertical conveying rollers 18. Then, the controller 6 performs the conveying speed control of the vertical conveying rollers 18 based on the measurement time Ta. Due to this, the timing at which each sheet P reaches the registration rollers 31 can be easily corrected by using the measurement time Ta also in the case where the sheets P are conveyed to the vertical conveying rollers 18 at multiple types of conveying speeds.

Specifically, the controller 6 controls the receiving speed duration time Tu and the abutting speed conveying time Tm based on the measurement time Ta. The controller 6 can thereby easily correct the timing at which each sheet P reaches the registration rollers 31 in the conveying speed control in which the colliding noise of the sheet P is suppressed by causing the sheet P to abut on the registration rollers 31 at the abutting speed Vm slower than the receiving speed Vu.

In the printer 1, the timing at which each sheet P reaches the registration rollers 31 can be easily corrected by using the measurement time Ta, also in the duplex printing in which the sheets P are conveyed from the internal paper feeding conveying rollers 16C and the circulation conveyer 4 to the vertical conveying rollers 18 at different conveying speeds.

Moreover, in the printer 1, the timing at which each sheet P reaches the registration rollers 31 can be easily corrected by using the measurement time Ta also in the case where the sheets P picked up from the internal paper feed trays 13A and 13B are conveyed to the vertical conveying rollers 18 at different conveying speeds as in the simplex printing in which sheets of different sizes mixedly exist.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a conveyer configured to convey sheets at a plurality of conveying speeds;

a conveying roller configured to receive a sheet conveyed by the conveyer at a receiving speed corresponding to a conveying speed in the conveyer and convey the sheet;

a registration roller configured to convey the sheet conveyed by the conveying roller to a printing unit; and a controller configured to drive the conveying roller to allow the sheet to abut on the registration roller and to stop, and to drive the registration roller to convey the sheet abutting on the registration roller to the printing unit at a set sheet interval, wherein the controller is configured to control a conveying speed of the conveying roller based on a time from a first timing to a second timing, the first timing being a time at which a preceding sheet conveyed from the registration roller to the printing unit exits the conveying roller, the second timing being a time at which a following sheet reaches the conveying roller, wherein the conveying roller is configured to convey the sheet at the receiving speed and then convey the sheet so as to allow the sheet to abut on the registration roller at an abutting speed slower than the receiving speed and then to stop the sheet, and wherein the controller is configured to calculate a conveying time of the conveying roller at the receiving speed after the second timing and a conveying time of the conveying roller at the abutting speed, based on the time from the first timing to the second timing.

2. The printer according to claim 1, wherein the conveyer comprises:

a paper feeding conveyer configured to convey the sheet picked up from a paper feed tray; and a paper refeeding conveyer configured, in duplex printing, to convey the sheet with a front side printed at a conveying speed different from a conveying speed of the paper feeding conveyer.

3. The printer according to claim 1, wherein the conveyer is configured to convey each of sheets picked up from a plurality of paper feed trays at a conveying speed set for the paper feed tray from which the sheet is fed, of different conveying speeds set for the respective paper feed trays.

* * * * *